US007736175B1

(12) United States Patent
Savicki, Jr. et al.

(10) Patent No.: US 7,736,175 B1
(45) **Date of Patent: *Jun. 15, 2010**

(54) COMPACT ELECTRICAL WIRING SYSTEM

(75) Inventors: Gerald R. Savicki, Jr., Canastota, NY (US); John Benoit, Montpelier, VT (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/396,214

(22) Filed: Mar. 2, 2009

Related U.S. Application Data

(63) Continuation-in-part of application No. 11/933,943, filed on Nov. 1, 2007, now Pat. No. 7,497,725, which is a continuation of application No. 11/691,116, filed on Mar. 26, 2007, now Pat. No. 7,470,145, which is a continuation of application No. 11/357,563, filed on Feb. 17, 2006, now Pat. No. 7,195,517, which is a continuation of application No. 11/032,420, filed on Jan. 10, 2005, now Pat. No. 7,189,110, which is a continuation-in-part of application No. 10/680,797, filed on Oct. 7, 2003, now Pat. No. 6,994,585.

(51) Int. Cl.
*H01R 13/60* (2006.01)

(52) U.S. Cl. ..... 439/535; 439/536; 174/58

(58) Field of Classification Search ..... 439/535, 439/536, 650, 107; 174/58
See application file for complete search history.

(56) References Cited

U.S. PATENT DOCUMENTS

| | | | |
|---|---|---|---|
| 2,433,917 | A | 1/1948 | McCartney |
| 2,895,119 | A | 7/1959 | Montgomery, Jr. |
| 3,156,761 | A | 11/1964 | Schinske |
| 3,192,499 | A | 6/1965 | West |
| 3,369,211 | A | 2/1968 | Sundquist |
| 3,641,472 | A | 2/1972 | Phillips, Jr. |
| 3,879,101 | A | 4/1975 | McKissic |
| 3,952,244 | A | 4/1976 | Spear |
| 3,967,195 | A | 6/1976 | Averitt et al. |

(Continued)

OTHER PUBLICATIONS

Richter et al., Practical Electrical Wiring, 1993, 16th Edition, McGraw-Hill, U.S.; pp. 137-139, 176-177, 507-510.

(Continued)

*Primary Examiner*—Tho D Ta
(74) *Attorney, Agent, or Firm*—Daniel P. Malley; Bond, Schoeneck & King, PLLC

(57) ABSTRACT

The present invention is directed to a electrical wiring system that includes a plug connector having a plurality of plug contacts configured to terminate a plurality of wires. The system also includes an electrical wiring device having a cover member, a body member, a ground strap assembly disposed between the cover member and the body member, and a receptacle formed in a rear portion of the body member, the receptacle being configured to accept the plug connector. The ground strap assembly is configured to conform to at least one body member feature such that a distance from the ground strap assembly to a major rear surface of the body member is less than a predetermined distance. The receptacle includes a plurality of receptacle contacts configured to mate with the plurality of plug contacts when the plug connector is inserted into the receptacle.

44 Claims, 11 Drawing Sheets

U.S. PATENT DOCUMENTS

| | | | |
|---|---|---|---|
| 3,975,074 | A | 8/1976 | Fuller |
| 3,975,075 | A | 8/1976 | Mason |
| 4,008,940 | A | 2/1977 | Foley |
| 4,015,201 | A | 3/1977 | Chaffee |
| 4,034,284 | A | 7/1977 | Peplow et al. |
| 4,082,995 | A | 4/1978 | Rhude |
| 4,105,968 | A | 8/1978 | Mobley et al. |
| 4,118,690 | A | 10/1978 | Paynton |
| 4,127,807 | A | 11/1978 | Peplow et al. |
| 4,152,639 | A | 5/1979 | Chaffee |
| 4,203,638 | A | 5/1980 | Tansi |
| 4,217,619 | A | 8/1980 | Tibolla |
| 4,280,092 | A | 7/1981 | Wells, Jr. et al. |
| 4,477,141 | A | 10/1984 | Hardesty |
| 4,485,282 | A | 11/1984 | Lee |
| 4,725,429 | A | 2/1988 | Scott |
| 4,842,551 | A | 6/1989 | Heimann |
| 4,865,556 | A | 9/1989 | Campbell et al. |
| 5,006,075 | A | 4/1991 | Bowden, Jr. |
| 5,015,203 | A | 5/1991 | Furrow |
| 5,117,122 | A | 5/1992 | Hogarth |
| 5,146,385 | A | 9/1992 | Misencik |
| 5,178,555 | A | 1/1993 | Kilpatrick et al. |
| 5,224,009 | A | 6/1993 | Misencik |
| 5,266,039 | A | 11/1993 | Boyer et al. |
| 5,281,154 | A | 1/1994 | Commerci et al. |
| 5,285,163 | A | 2/1994 | Liotta |
| 5,297,973 | A | 3/1994 | Gorman |
| 5,456,373 | A | 10/1995 | Ford |
| 5,472,350 | A | 12/1995 | Mehta |
| 5,582,522 | A | 12/1996 | Johnson |
| 5,625,285 | A | 4/1997 | Virgilio |
| 5,642,052 | A | 6/1997 | Earle |
| 5,654,857 | A | 8/1997 | Gershen |
| 5,785,551 | A | 7/1998 | Libby |
| 5,839,908 | A | 11/1998 | Bonilla |
| 5,964,618 | A | 10/1999 | McCarthy |
| 6,028,268 | A | 2/2000 | Stark et al. |
| 6,045,374 | A | 4/2000 | Candeloro |
| 6,054,849 | A | 4/2000 | Collier et al. |
| 6,072,317 | A | 6/2000 | Mackenzie |
| 6,156,971 | A | 12/2000 | May |
| 6,218,844 | B1 | 4/2001 | Wong et al. |
| 6,309,248 | B1 | 10/2001 | King |
| 6,323,652 | B1 | 11/2001 | Collier et al. |
| 6,376,770 | B1 | 4/2002 | Hyde |
| 6,377,427 | B1 | 4/2002 | Haun et al. |
| 6,457,988 | B1 | 10/2002 | Andersen |
| 6,494,728 | B1 | 12/2002 | Gorman |
| 6,563,049 | B2 | 5/2003 | May |
| 6,657,144 | B2 | 12/2003 | Savicki, Jr. |
| 6,692,284 | B1 | 2/2004 | Koh |
| 6,753,471 | B2 | 6/2004 | Johnson |
| 6,767,245 | B2 | 7/2004 | King |
| 6,774,307 | B2 | 8/2004 | Kruse et al. |
| 6,814,611 | B1 | 11/2004 | Torres |
| 6,870,099 | B1 | 3/2005 | Schultz |
| 6,939,179 | B1 | 9/2005 | Kieffer, Jr. |
| 6,982,558 | B2 | 1/2006 | Bryndzia et al. |
| 6,994,585 | B2 | 2/2006 | Benoit |
| 7,057,401 | B2 | 6/2006 | Blades |
| 7,068,038 | B2 | 6/2006 | Mason et al. |
| 7,091,723 | B2 | 8/2006 | Simmons et al. |
| 7,195,517 | B1 | 3/2007 | Savicki, Jr. |
| 7,199,587 | B2 | 4/2007 | Hurwicz |
| 7,259,567 | B2 | 8/2007 | Sears et al. |
| 7,470,145 | B1 * | 12/2008 | Savicki et al. ..... 439/535 |
| 2002/0052139 | A1 | 5/2002 | Gorman |
| 2002/0055301 | A1 | 5/2002 | Gorman |
| 2005/0006124 | A1 | 1/2005 | Kruse et al. |

OTHER PUBLICATIONS

Bryant Wiring Device Catalog BDB-1506, May 1994, pp. C12, D12, D16, F2 and F5.

Leviton Wiring Device Catalog, D-200, 1978, Little Neck, NY, pp. C1, T9, T12.

Pass & Seymour Plug Tail Wiring Devices Brochure; Apr. 2004.

First Alert, User's Manual for Smoke and Fire Alarms, Jul. 2004; Mexico, pp. 1-6.

Earley et al., NEC 1999 National Electrical Code Handbook, NFPA, 8th ed. (1999) pp. v-vii, 2, 69-70 and 98.

BRK Electronics, User's Manual—Smoke Alarms Jun. 2000.

T. Engdahl, Telephone Ringing Circuits, 1997, www.tkk.fi/misc/electronics/circuits/telephone_ringer.html.

P&S PlugTail Installation—Speed Comparison Video, Pass & Seymour website (www.passandseymour.com/plugtail/video.cfm, Jun. 2007.

BRK Electronics (First Alert), Model SC6120B—User's Manual for AC Powered Smoke and Carbon Monoxide Alarm with Batter Back-Up and Silence Feature, 2001.

NEC 2005 Handbook, 2005, Article 314-17, Conductors Entering Boxes, Conduit Bodies, or Fittings, National Fire Protection Association, Inc., p. 327.

UL Standard 514A, Metallic Outlet Boxes, Underwriters Laboratories Inc., Tenth Edition, 2004, p. 39.

* cited by examiner

Figure 10
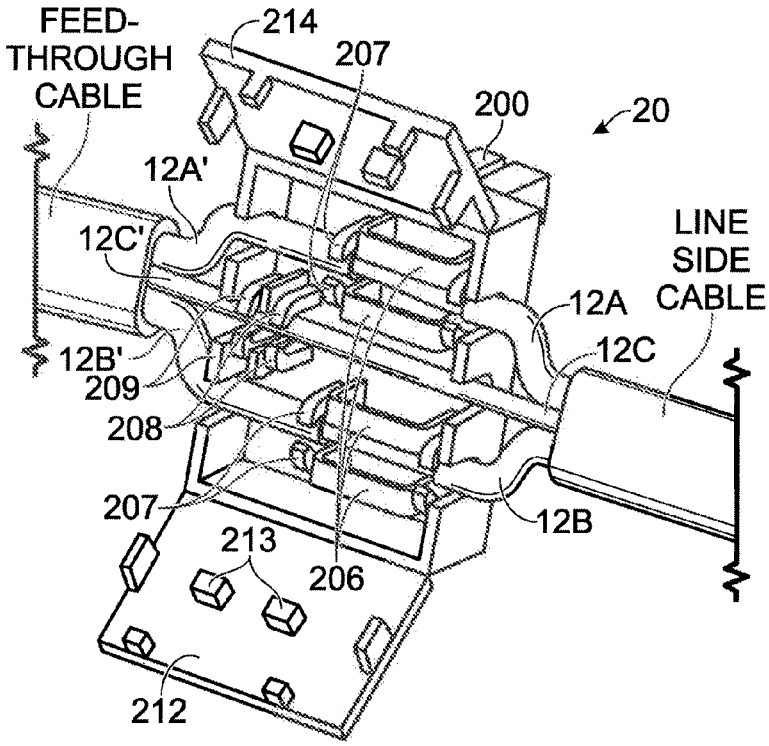
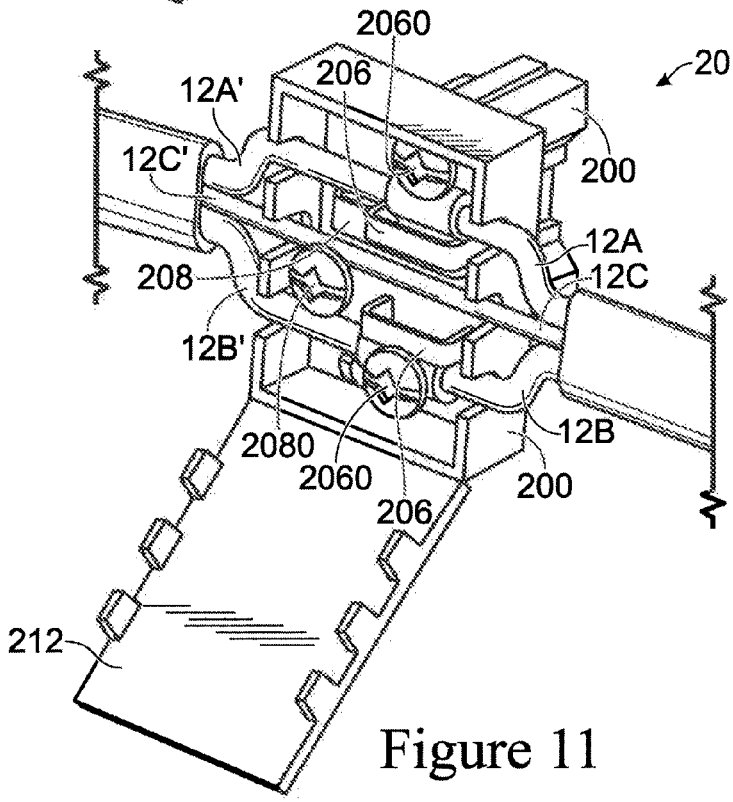
Figure 11

COMPACT ELECTRICAL WIRING SYSTEM

CROSS-REFERENCE TO RELATED APPLICATIONS

This is a continuation-in-part of U.S. patent application Ser. No. 11/933,943, filed on Nov. 1, 2007, which is a continuation of U.S. patent application Ser. No. 11/691,116 filed on Mar. 26, 2007, which is a continuation of Ser. No. 11/357,563 filed on Feb. 17, 2006, which is a continuation of U.S. patent application Ser. No. 11/032,420 filed on Jan. 10, 2005, which is a continuation-in-part of U.S. patent application Ser. No. 10/680,797 filed on Oct. 7, 2003, the contents of which is relied upon and incorporated herein by reference in their entirety, and the benefit of priority under 35 U.S.C. §120 is hereby claimed.

BACKGROUND OF THE INVENTION

1. Field of the Invention

The present invention relates generally to electrical devices, and particularly to compact electrical wiring devices.

2. Technical Background

Electrical circuit installation is a labor intensive and time consuming process that may require electricians of various skill levels. Essentially, the process includes several phases. The first phase is commonly referred to as the rough-in stage. The second stage may be referred to as the termination phase.

During the rough-in stage either conduit or armored cable is placed throughout the structure as per the build-out plans. Junction boxes and wiring device boxes are also installed throughout the structure. Junction boxes are deployed to house connection points where two or more conductors are to be joined. Wiring device boxes are deployed at locations where electrical service is desired. After the boxes have been placed in the structure, the electrical cabling is pulled through the conduits. At the end of this step in the process, electrical wiring is disposed between the distribution panel and each wiring device box. The leads from the electrical wiring extend from the boxes and are visible and accessible for the next phase of the installation process.

As noted above, after the rough-in process is complete the electrical devices must terminated, i.e., the electrical wires are connected to the electrical wiring devices. Accordingly, each electrical wire is stripped and connected to the terminals of the electrical device.

There are drawbacks to the process described above. One drawback relates to the rough-in phase of the process, while another drawback relates to the termination phase. With regard to the rough-in phase, in conventional grounding circuits, the conduit system is employed as the grounding path. The conduit system is grounded at the service entrance and connected to intervening sub-panels, grounded structures, and other grounded equipment. While this grounding method affords protection to both personnel and equipment, it may be problematic from an electromagnetic (EMI) standpoint. In particular, the conduit system may function as an antenna that receives electromagnetic noise propagating in the environment. The electromagnetic noise is transmitted by the conduit system as EMI. As those skilled in the art will recognize EMI may adversely affect the performance of electronic equipment such as computers, telecommunications equipment, testing and calibration equipment, and solid state cash registers, to name a few non-limiting examples.

With regard to the termination phase of the installation process, this aspect of the installation process is the most time consuming portion of the process, and hence, the most costly.

A journeyman electrician must perform or supervise the termination of each wiring device.

Accordingly, what is needed is an efficient, labor saving, and cost-effective system for terminating electrical devices to the electrical wiring system. Further, what is also needed is an electrical circuit installation system and method that prevents the propagation of electromagnetic noise within a structure's conduit system.

SUMMARY OF THE INVENTION

The present invention addresses the needs identified above. The present invention provides an efficient, labor saving, and cost-effective system for terminating electrical devices to the electrical wiring system. Further, the present invention provides an electrical circuit installation system and method that prevents the propagation of electromagnetic noise within a structure's conduit system.

One aspect of the present invention is directed to an electrical wiring system for use in an AC electrical circuit disposed between an AC distribution point and a terminus point. The AC electrical circuit includes a hot AC power transmitting wire and a neutral AC power transmitting wire extending from the AC power distribution point to at least one wiring box. The AC distribution point is in an upstream direction relative to the at least one wiring box and the terminus point is in a downstream direction relative to the at least one wiring box. The at least one wiring box has at least one aperture and an open side. The AC hot power transmitting wire and the AC neutral power transmitting wire are routed into the at least one aperture and accessible at the open side after a rough-in phase of installation. The system includes a connector including a housing having a connector hot contact assembly and a connector neutral contact assembly disposed therein. The housing includes at least one first connector power interface and a second connector power interface. The at least one first connector power interface includes a first hot contact portion of the connector hot contact assembly and a first neutral contact of the connector neutral contact assembly. The first hot contact portion is configured to terminate the hot AC power transmitting wire such that a first portion of the hot AC power transmitting wire extends in the upstream direction and a second portion of the hot AC power transmitting wire extends in the downstream direction. The first neutral contact portion is configured to terminate the neutral AC power transmitting wire such that a first portion of the neutral AC power transmitting wire extends in the upstream direction and a second portion of the neutral AC power transmitting wire extends in the downstream direction, the second connector power interface including a second hot contact portion of the connector hot contact assembly and a second neutral contact portion of the connector neutral contact assembly, the connector not being configured to connect to the wiring box. An electrical wiring device includes a device housing having a cover portion and rear portion. The cover portion includes at least one user-accessible interface element connected to an AC electric circuit disposed in the device housing. The electrical wiring device also includes mounting structure coupled to the device housing. The mounting structure is configured to couple the electrical wiring device to the device box. The electrical wiring device further includes a wiring device power interface including a hot AC electric contact and a neutral AC electric contact. The wiring device power interface is configured to mate with the second connector power interface to establish electrical connectivity between the hot AC electric contact and the second hot contact portion, and the neutral AC electric contact and the second neutral contact portion.

In another aspect, the present invention is directed to an electrical wiring system that includes electrical wiring system for use in an AC electric power distribution system. The AC electric power distribution system includes a plurality of AC electric power transmitting wires including a plurality of hot power transmitting wires and a plurality of neutral power transmitting wires, the at least one wiring box having at least one aperture and an open side. The plurality of hot power transmitting wires and the plurality of neutral power transmitting wires are routed into a device box and accessible at an open side of the device box after a rough-in phase of installation. The system includes a connector including a connector housing. A plurality of first contacts are disposed in a predetermined pattern within the connector housing including a hot contact and a neutral contact. A termination arrangement is connected to the plurality of first contacts. The termination arrangement is configured to terminate the plurality of AC electric power transmitting wires by electrically connecting the plurality of hot power transmitting wires together and electrically connecting the plurality of neutral power transmitting wires together. The connector and the termination arrangement are arranged in a detached relationship relative to the device box after termination. An electrical wiring device includes a device housing having a face portion and rear portion. The face portion includes a first set of receptacle blade openings disposed at one end of the device housing and a second set of receptacle blade openings disposed at an opposite end of the device housing. A mounting structure is coupled to the device housing. The mounting structure is configured to couple the electrical wiring device to the device box. A hot contact structure is disposed in the housing and including a first hot face receptacle contact structure in communication with a corresponding one of the first set of receptacle blade openings, a second hot face receptacle contact structure in communication with a corresponding one of the second set of receptacle blade openings, and a hot contact accessible via the connection arrangement. A neutral contact structure is disposed in the housing and including a first neutral face receptacle contact structure in communication with a corresponding one of the first set of receptacle blade openings, a second neutral face receptacle contact structure in communication with a corresponding one of the second set of receptacle blade openings, and a neutral contact accessible via the connection arrangement. The connection arrangement is configured to latch the connector in a mating relationship such that the plurality of first contacts mate with the hot contact and the neutral contact to establish electrical continuity therebetween.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

BRIEF DESCRIPTION OF THE DRAWINGS

FIG. 10 is a perspective view of a feed-through connector depicted in FIG. 9;

FIG. 11 is an alternate perspective view of the feed-through connector depicted in FIG. 9;

DETAILED DESCRIPTION

Figure 1:
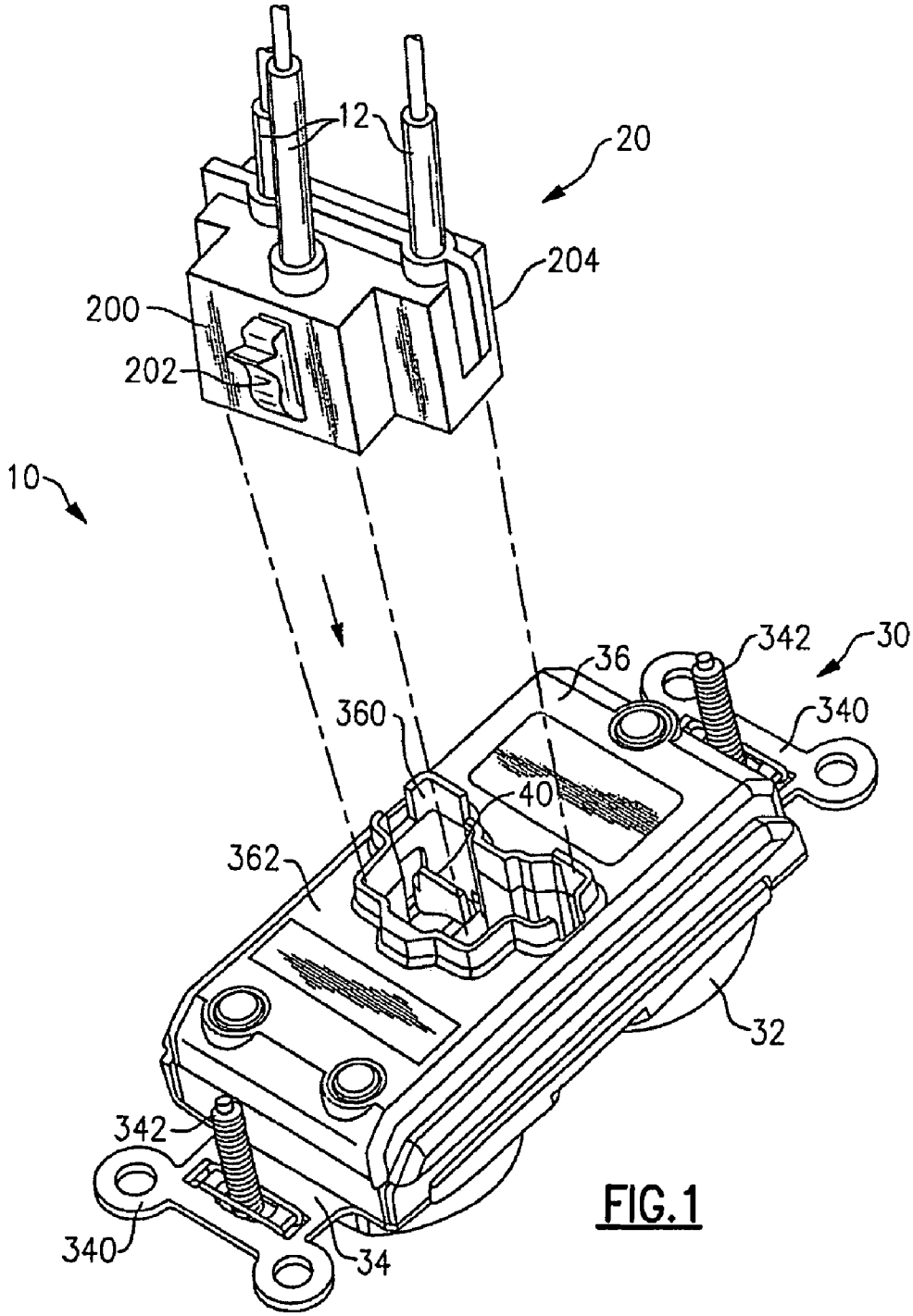
FIG. 1 is a perspective view of an electrical wiring system in accordance with an embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the electrical wiring system of the present invention is shown in FIG. 1, and is designated generally throughout by reference numeral 10.

In accordance with the invention, the present invention is directed to an electrical wiring system that includes a plug connector including a plurality of plug contacts. The plug connector is configured to terminate a plurality of wires. An electrical wiring device includes a cover member, a body member, and a ground strap disposed between the cover member and the body member. The body member includes a receptacle configured to accept the plug connector and a plurality of device contacts. The plurality of device contacts are configured to mate with the plurality of plug contacts when the plug connector is inserted into the receptacle. Accordingly, the present invention provides an efficient, labor saving, and cost-effective system for terminating electrical devices to the electrical wiring system. The present invention also provides an electrical circuit installation system and method that prevents the propagation of electromagnetic noise within a structure's conduit system.

As embodied herein, and depicted in FIG. 1, a perspective view of an electrical wiring system in accordance with an embodiment of the present invention is disclosed. As noted above, the wiring system 10 includes plug connector 20 and wiring device 30. The plug connector includes a body member 200 that has contacts disposed therein (not shown in this view). Each plug contact is terminated to one of the plurality of wires 12. Body 200 includes a latch member 202 configured to hold the plug connector in-place within the body 36 of wiring device 30. Wiring device 30 includes a cover 32, a body 36, and a generally planar ground strap 34 that is disposed between cover 32 and body 36. As shown, the planar ground strap includes a proximal mounting yoke 340 and a distal mounting yoke 340 disposed on opposing ends of ground strap 34. Mounting screws 342 are employed to mount the wiring device to a structure. Referring back to body member 36, a receptacle 360 in formed in the major rear surface 362. A portion of the wiring device contact assembly 40 is accessible via the receptacle 360. Indeed, receptacle 360 is configured to accept the plug connector 20. The wiring device contacts 40 are configured to mate with the plurality of plug contacts (not shown in this view) when the plug connector 20 is inserted into the receptacle 360.

Figure 2:
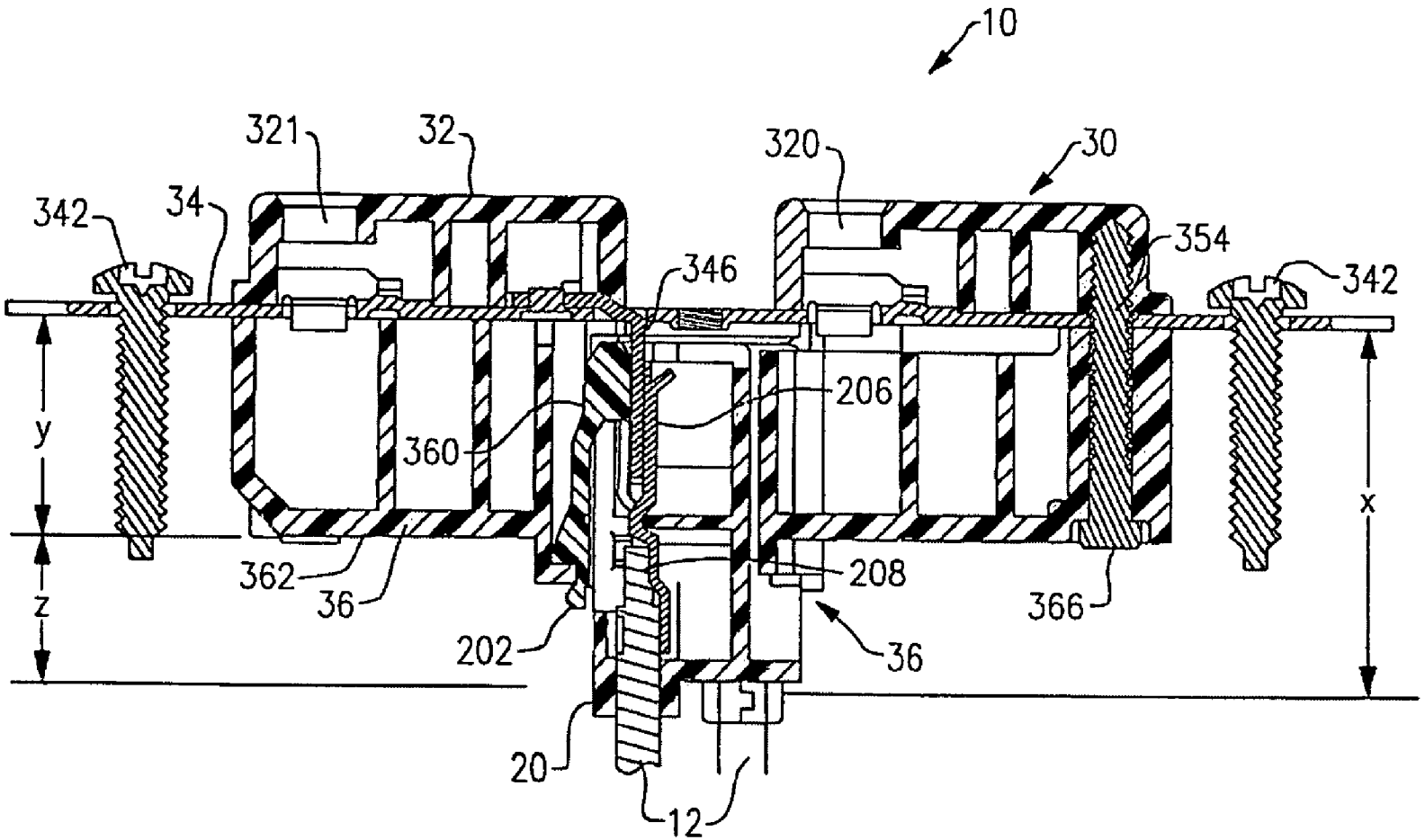
FIG. 2 is a cross-sectional view of the electrical wiring system shown in FIG. 1 with the plug connector inserted into the receptacle.

FIG. 2 is a cross-sectional view of the electrical wiring system 10 shown in FIG. 1 with the plug connector inserted into the receptacle. Cover 32, ground strap 34, and body member 36 are joined together as a single unit 30 by inserting screws 366 into holes 364 disposed in body member 36. Screws 366 pass through the holes 354 disposed in ground strap 34 and are tightened by screw threads disposed in cover 32.

In FIG. 2, plug connector 20 is inserted into receptacle 360. Plug body 200 fits snugly into receptacle 360. When fully inserted, latch member 202 prevents plug body 200 from disengaging receptacle 360. In the interior portion of plug body 200, wires 12 are connected to plug contacts 206 at termination point 208. The plug contact depicted in FIG. 2 is a ground contact that is engaged with receptacle ground contact 346. In one embodiment of the present invention, there is electrical continuity between wire 12, contact 206, device contact 346, and ground strap 34. In another embodiment, device ground contact 346 is electrically isolated from ground strap 34. Accordingly, there is only electrical continuity between wire 12, contact 206, and device ground contact 346.

FIG. 2 provides three dimensions. Dimension "x" is a variable dimension from the back of ground strap 34 to the bottom of plug connector 20. The value of dimension "x" is largely dependent on dimension "y", which is the distance from the back of strap 34 to the rear major surface 362 of body 36. Dimension "z" is the distance that a fully inserted plug connector 20 extends from the major rear surface 362 of body 36. Referring back to dimension "y", the distance from the back of strap 34 to the rear major surface 362 of body 36 may vary depending on the functionality of the wiring device 10. If wiring device 10 only includes user accessible receptacles 320, then "y" may equal approximately 0.635". However, in certain instances "y" may be as great as 2.50". In certain embodiments, "z" is approximately 0.436". The thickness of cover member 32 is typically 0.358". A typical thickness of ground strap 34 is approximately 0.042". As noted above, body member 36 may be altered to accommodate any number of electrical wiring devices. Examples of such devices include, but are not limited to, electrical receptacles, various types of switches, ground fault circuit interrupters (GFCIs), and/or arc fault circuit interrupters (AFCIs).

Figure 3:
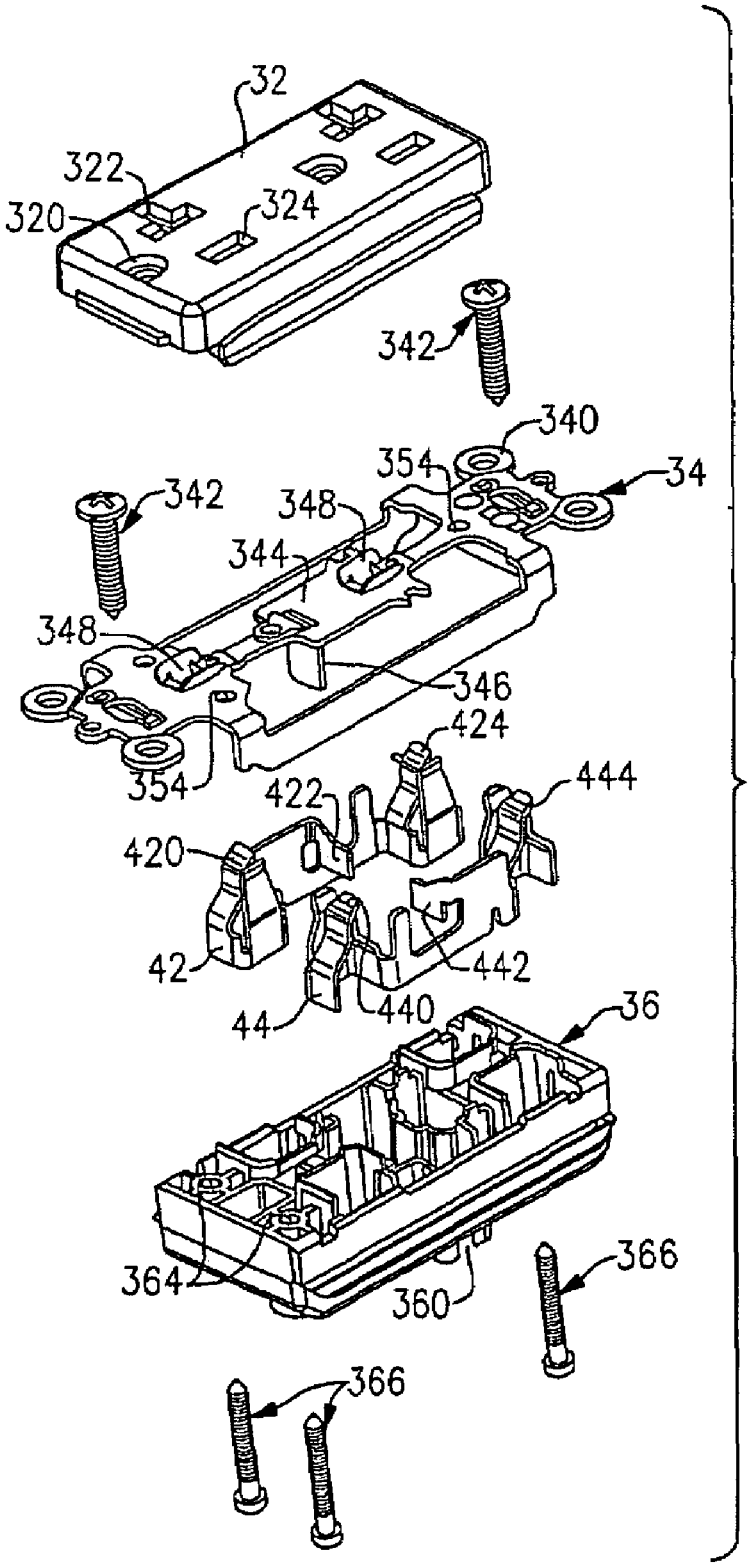
FIG. 3 is an exploded view of a wiring device in accordance with a first embodiment of the present invention.

Referring to FIG. 3, an exploded view of a wiring device in accordance with a first embodiment of the present invention is disclosed. As shown, ground strap 34 is generally planar in nature and includes an aperture on either side of central portion 344 to accommodate neutral contact assembly 42 and hot contact assembly 44. Neutral contact assembly 42 includes user accessible contacts 420 and 424. Neutral contacts 420, 424 are aligned with user accessible neutral blade receptacle 322 in cover 32. Contact 422 is configured to mate with the plug neutral contacts disposed in plug connector 20. Similarly, hot contacts 440, 444 are aligned with user accessible hot blade receptacle 324 in cover 32. Contact 442 is configured to mate with the plug hot contacts disposed in plug connector 20. Note also that planar ground strap 34 includes a ground blade 346 that is configured to mate with the ground contacts disposed in plug connector 20. Cover 32 also includes ground blade receptacle openings 320. Openings 320 are aligned with ground contacts 348 disposed on ground strap 34. As noted above, the wiring device 10 is joined together by screws 366, which are inserted through holes 364 in the body member 36 and holes 354 disposed in ground strap 34. Cover member 32 includes screw threads that accommodate screws 366.

Figure 4A:
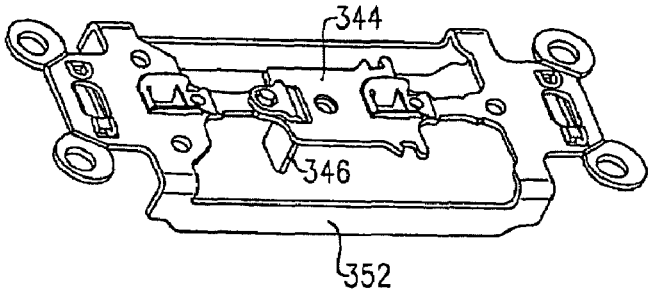
FIG. 4A is a detail view of the ground strap assembly shown in FIG. 3.
Figure 4B:
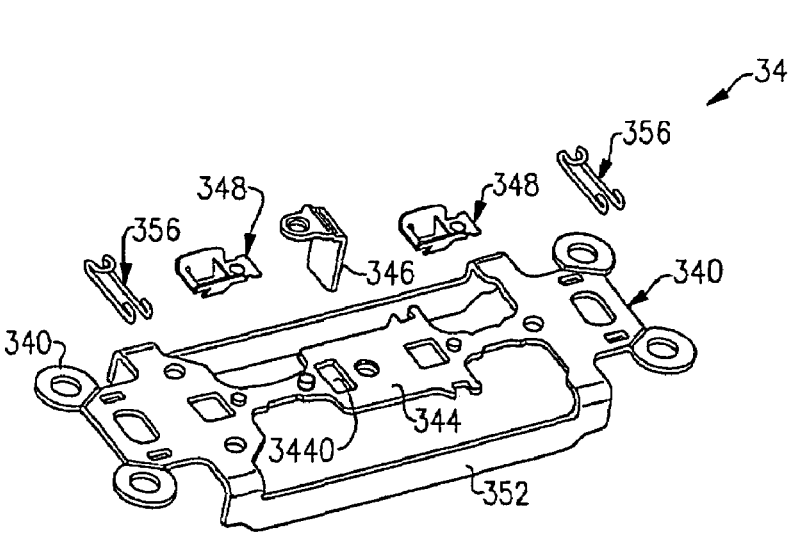
FIG. 4B is an exploded view of the ground strap assembly shown in FIG. 4A.

FIG. 4A is a detail view of the ground strap assembly shown in FIG. 3. FIG. 4B is an exploded view of the ground strap assembly 34 shown in FIG. 4A. Ground strap 34 includes a two mounting yokes 340 that are disposed at a proximal end of the ground strap and a distal end of the ground strap. The mounting yokes are connected along a central axis of the ground strap by central portion 344. The mounting yokes and central portion 344 are disposed in a single plane, i.e., these elements are coplanar. Ground contact 346 is riveted to central portion 344 and is configured to extend through hole 3440 into receptacle 360. Ground contacts 348 are riveted to ground strap 34 on either side of central portion 344. These contacts are aligned with user accessible ground blade apertures formed in cover member 32.

Ground strap 34 also includes two lateral support members 352 that rigidly interconnect the two mounting yokes 340. As shown, the lateral support members 352 are substantially parallel one to the other and disposed along a lateral side portion of the body member perimeter.

Figure 5:
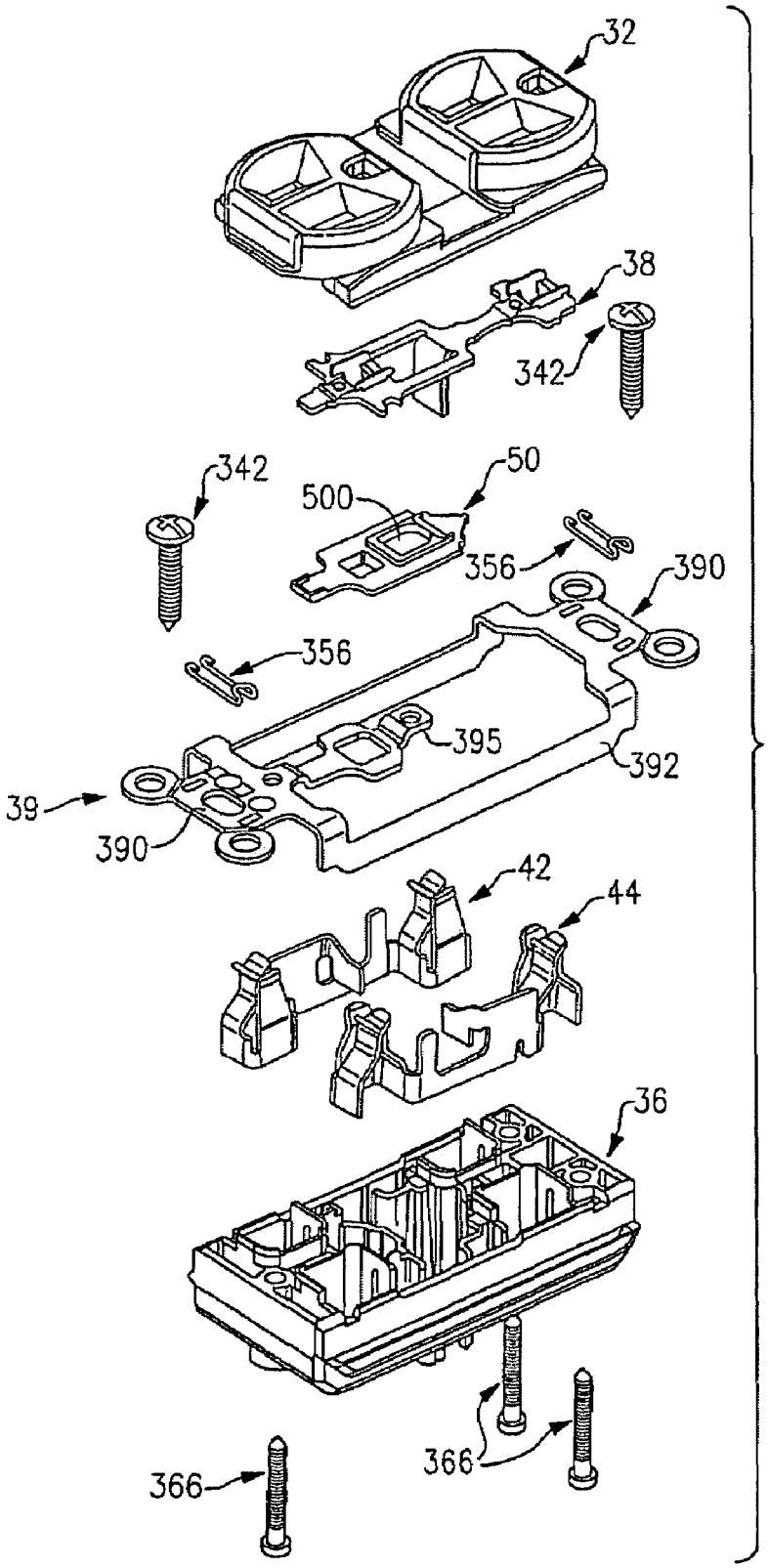
FIG. 5 is an exploded view of a wiring device in accordance with a second embodiment of the present invention.

As embodied herein and depicted in FIG. 5, an exploded view of a wiring device 10 in accordance with a second embodiment of the present invention is disclosed. Of interest in this embodiment is modified ground strap 39, ground plate 38, and insulator member 50. With regard to ground strap 39, the central portion 395 does not interconnect the proximal and distal mounting yokes 390. However, ground strap 39 includes lateral support members 392. Support members 392 are identical to those previously described. Instead of riveting the ground contacts to the ground strap as described in the first embodiment, an isolated ground plate 38 is provided. To provide electrical isolation, insulator member 50 is disposed between the ground plate 38 and the ground strap 39. Accordingly, the mounting yokes 390 are grounded to the conduit system, whereas equipment ground is directly connected to the neutral at the service entrance, by way of the an insulated equipment ground conductor. In essence, the conduit grounding system is electrically isolated from the grounding circuit. This arrangement eliminates the EMI propagating in the conduit system. As such, a relatively noise free grounding path is provided, resulting in improved electronic equipment operation.

Figure 6:
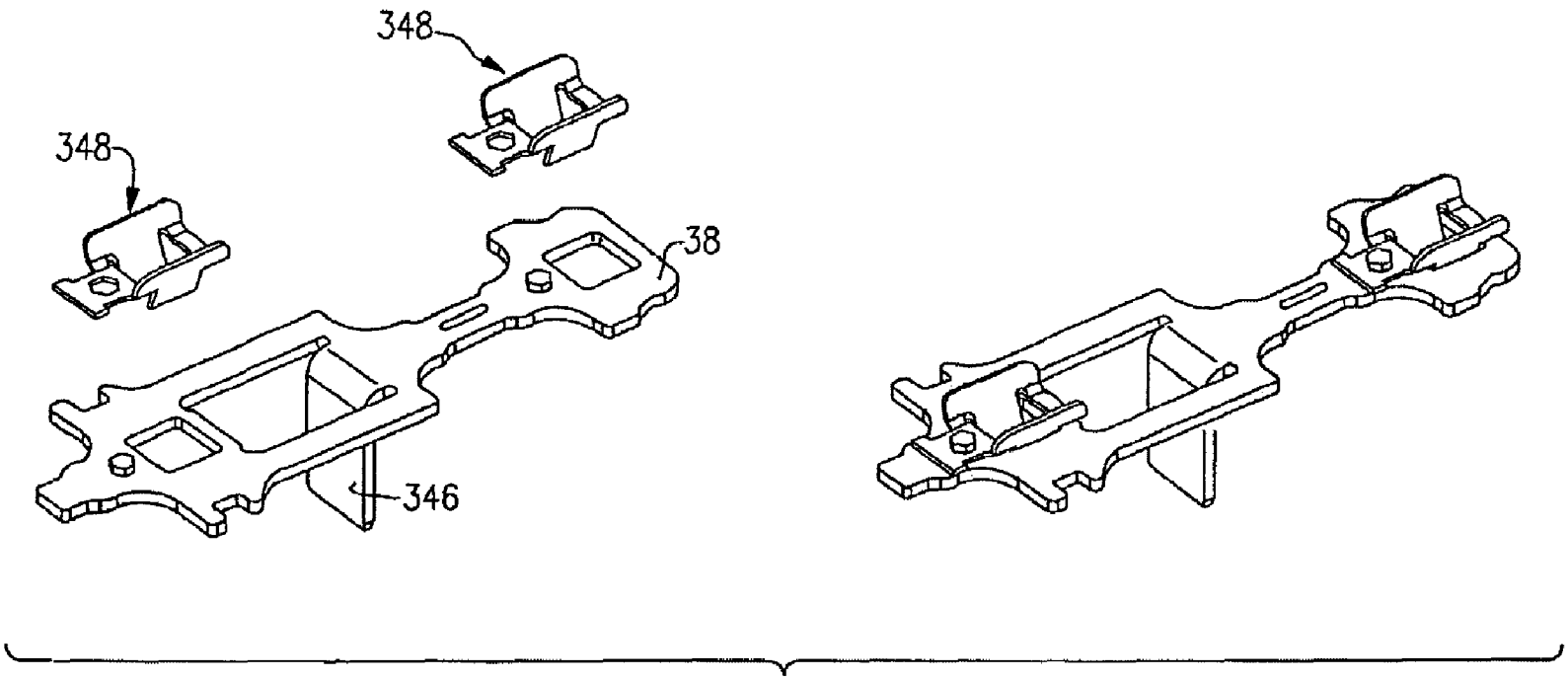
FIG. 6 is a detail view of the isolated ground plate shown in FIG. 5.

FIG. 6 is a detail view of the isolated ground plate shown in FIG. 5. This detail view highlights the fact that user accessible ground contacts 346, 348 are riveted to ground plate 38, instead of to the ground strap 39.

Figure 7:
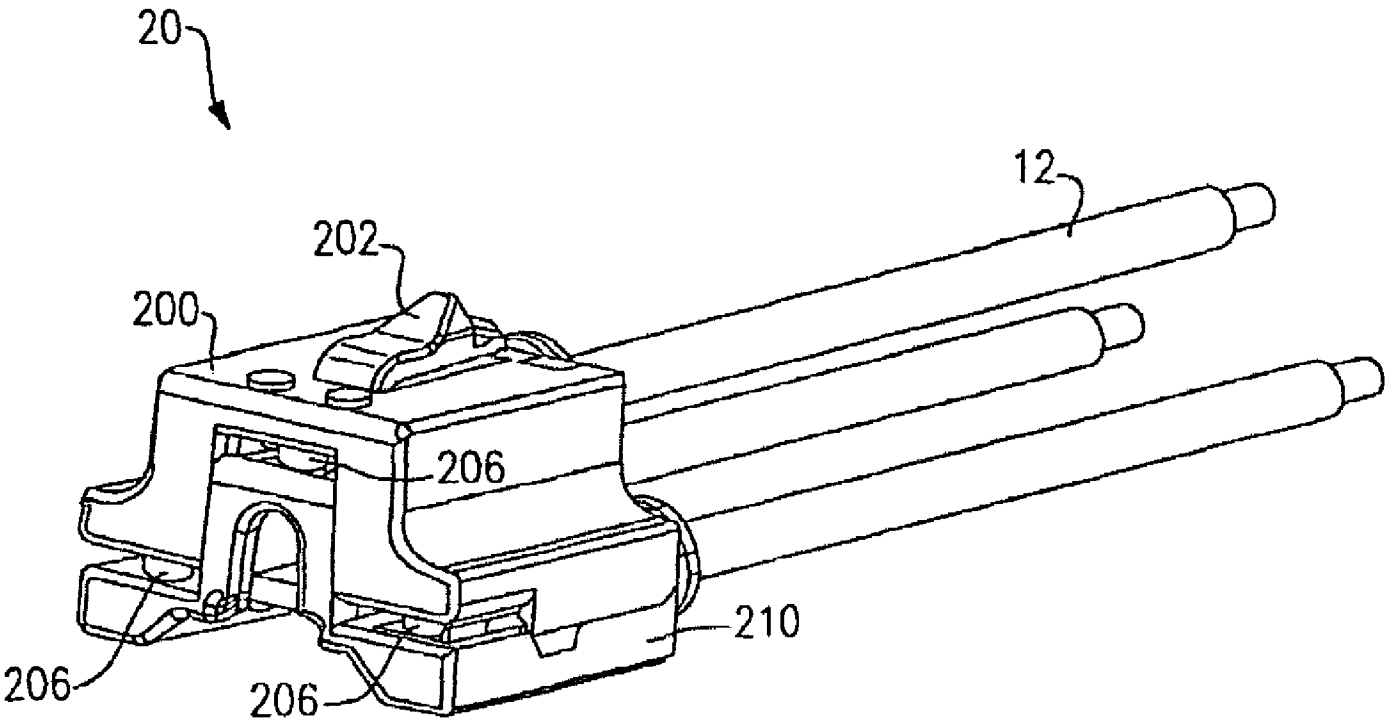
FIG. 7 is a perspective view of a plug connector in accordance with an embodiment of the present invention.

FIG. 7 is a perspective view of a plug connector in accordance with one embodiment of the present invention. Plug connector 20 includes an upper housing 200 and a lower housing 210. The upper housing 200 is snapped onto lower housing 210 to enclose and terminate wires 12 in plug connector 20. In this embodiment, connector 20 includes female plug contacts 206. When wires 12 are terminated, electrical connectivity is established between the female contacts 206 and wires 12. Plug connector 20, as noted previously, includes latch mechanism 202. When the plug connector 20 is inserted into receptacle 360, latch mechanism 202 flexes inwardly until the connector 20 is fully inserted. At that point, the latch 202 relaxes and emits an audible sound that indicates that the plug 20 was successfully inserted into the wiring device 30. Latch mechanism 202 may be flexed to remove plug connector 20 from receptacle 360. Reference is made to U.S. patent application Ser. No. 10/680,797, which is incorporated herein by reference as though fully set forth in its entirety, for a more detailed explanation of the plug connector 20.

Figure 8:
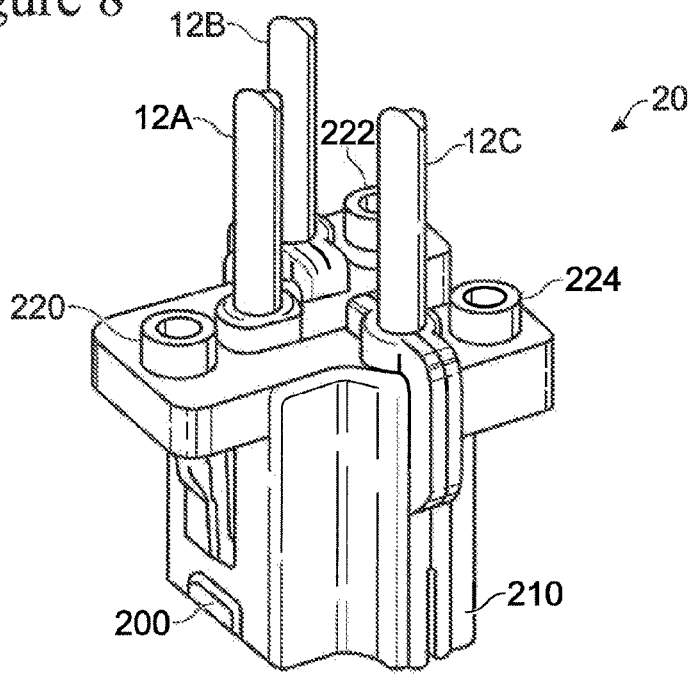
FIG. 8 is a perspective view of a feed-through connector in accordance with another embodiment of the present invention.

Referring to FIG. 8, a perspective view of a feed-through plug connector in accordance with an embodiment of the invention. As those of ordinary skill in the art will understand, receptacles are often daisy chained by way of feed through wires (not shown). In this embodiment, there is electrical connectivity between wire 12A and speed-wire terminal 220, wire 12B and speed-wire terminal 222, and wire 12C and speed-wire terminal 224. Those of ordinary skill in the art will recognize that feed through wires 12A', 12B', 12C' (not shown) are insertable into speed-wire terminals 220, 222, or 224, respectively, by any suitable means.

Figure 9:
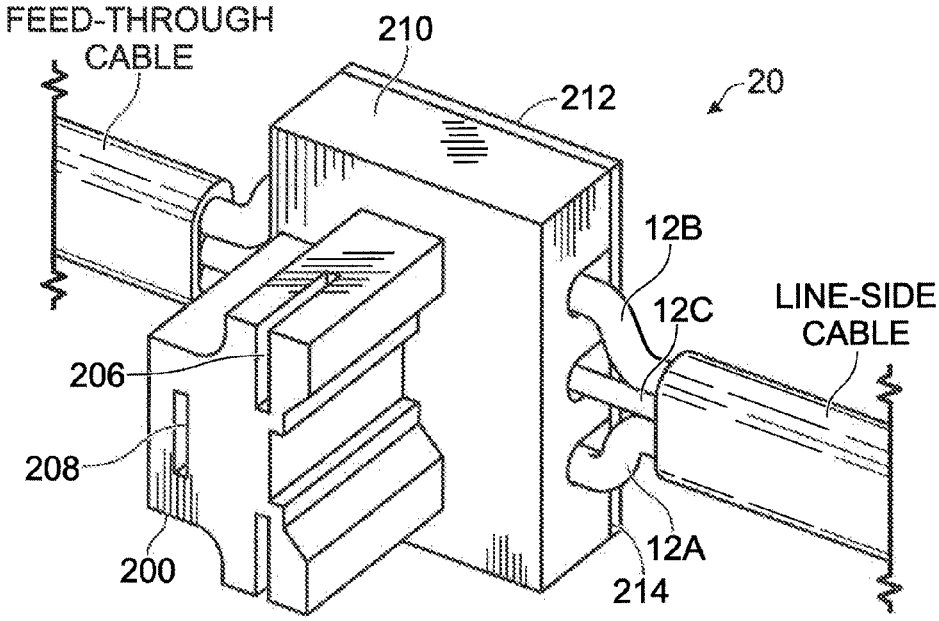
FIG. 9 is a perspective view of a feed-through connector in accordance with another embodiment of the present invention.

As embodied herein and depicted in FIG. 9, a perspective view of a feed-through connector 20 in accordance with another embodiment of the present invention is disclosed. Feed-through plug connector 20 includes a plug housing 200 and a feed-through interconnection housing 210. In this embodiment, the plug housing 200 includes female hot and neutral plug contacts 206 and a ground contact 208. Those skilled in the art will understand that contacts 206 and 208 may be of any suitable type and reference is made to U.S. patent application Ser. No. 10/680,797, which is incorporated herein by reference as though fully set forth in its entirety, for a more detailed explanation of plug connectors 20 and plug contacts (206, 208). As shown in subsequent Figures, portions of the contacts 206, 208 are accessible via the door portions 212, 214 of the interconnection housing 210. Note also that interconnection housing 210 includes wire slot features 216 on both the line side and the feed-through side thereof to accommodate the wires 12A (hot), 12B (neutral), 12C (ground) of the Romex cable.

Referring to FIG. 10, an alternative perspective view of the feed-through connector 20 depicted in FIG. 9 is disclosed. This view shows the door portions 212, 214 opened such that the interior of the interconnection housing 210 may be viewed. From this vantage point it is seen that the interconnection portion of contacts 206, 208 employ insulation displacement termination interfaces to terminate wires (12A, 12B, 12C) to the connector 20. Wires 12A and 12B are held within interconnection housing 210 by wire guides 207. When doors 212 and 214 are closed, wire drivers 213 press the wires into the insulation displacement terminals of contacts 206. Ground wire 12C is held within interconnection housing 210 by wire guide 209; wire drivers also press the ground wire 12C into the insulation displacement portion of contact 208. In this embodiment, even though the hot, neutral and ground wires are continuous the wire designations change from (12A, 12B, 12C) to (12A', 12B' 12C') to indicate the line side and the feed-through side, respectively.

Referring to FIG. 11, an alternate perspective view of the feed-through connector depicted in FIG. 9 is disclosed. In this embodiment, each contact 206 includes a screw plate assembly 2060 and ground contact 208 includes screw plate assembly 2080. After the wires (12A, 12B, 12C) are inserted into the insulation displacement portions of contacts 206 (208), the screw portion of the screw plate assembly 2060 (2080) are tightened down such that the plate more firmly forces the wire 12 into the insulation displacement portion of the contact to thereby ensure that the insulation surrounding wire 12 has indeed been displaced and that a solid termination connection has been realized. In this embodiment, the wire drivers formed on the inside of the doors 212 are not required.

When wires 12 are terminated, electrical connectivity is established between the female contacts 206, 208 and their respective wires 12A, 12B, 12C. The feed-through connector 20, like other connector 20 embodiments, includes a latch mechanism 202 (hidden in FIGS. 8-10). When the feed-through plug connector 20 is inserted into receptacle 360, latch mechanism 202 flexes inwardly until the connector 20 is fully inserted. At that point, the latch 202 relaxes and emits an audible sound that indicates that the plug 20 was successfully inserted into the wiring device 30. Latch mechanism 202 may be flexed to remove plug connector 20 from receptacle 360. When plug connector 20 is inserted into receptacle 360, latch mechanism 202 prevents plug 20 from being pulled out of receptacle 360. Latch mechanism 202 is configured to meet Underwriter's Laboratory (UL) standards for a locking connector. In this case, UL requires that a static pull test of 20 pounds be applied to the connector for one minute. During the test, plug connector 20 may not separate from receptacle 360.

Figure 12:
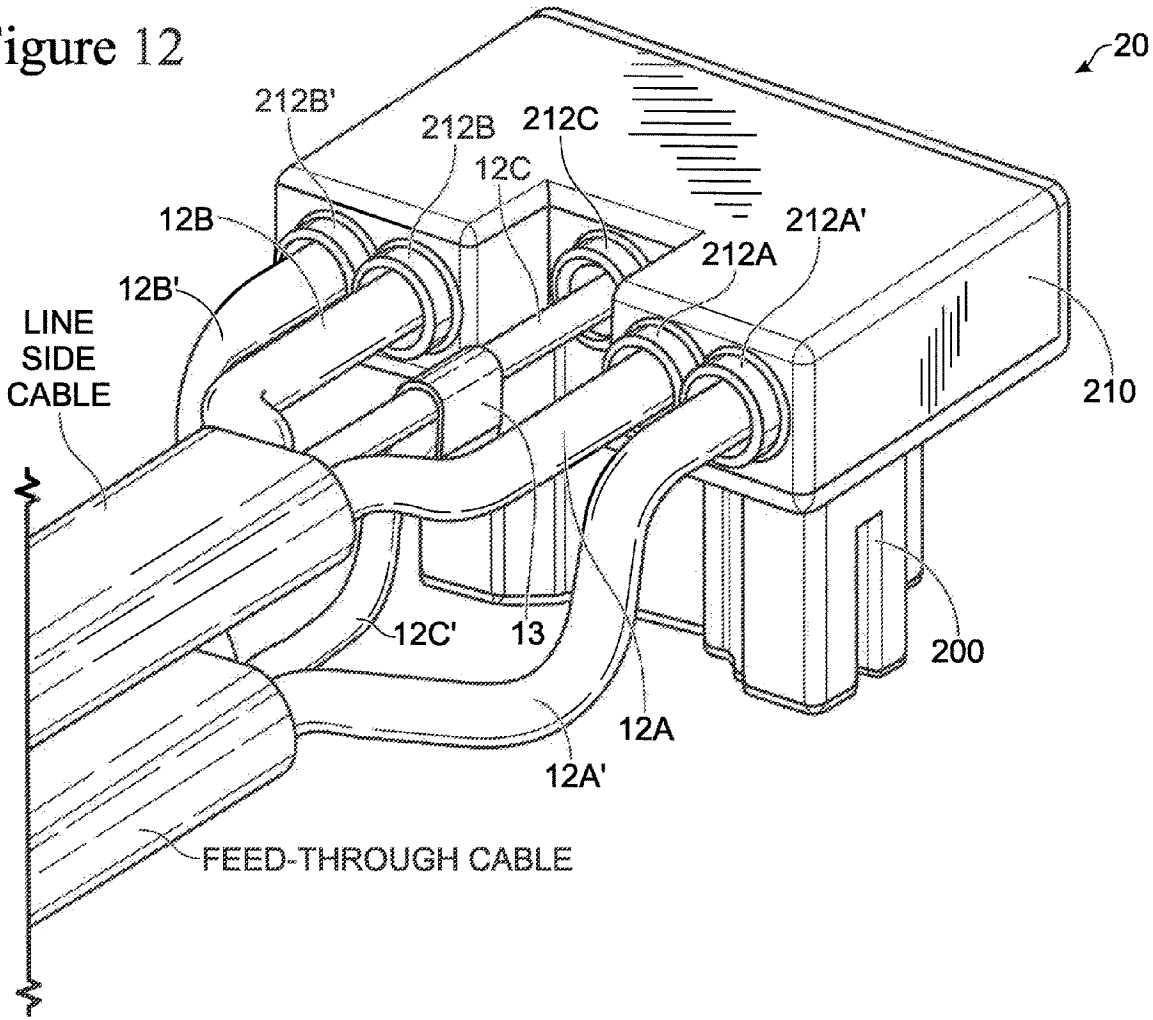
FIG. 12 is a perspective view of a feed-through connector in accordance with another embodiment of the present invention.

As embodied herein and depicted in FIG. 12, a perspective view of a feed-through connector 20 in accordance with another embodiment of the present invention is disclosed. Again, feed-through plug connector 20 includes a plug housing 200 and a feed-through interconnection housing 210. From left to right, feed-through neutral wire 12B' is inserted into speed-wire terminal 212B', line neutral wire 12B is inserted into speed-wire terminal 212B', ground wire 12C is inserted into speed-wire terminal 212C, line hot wire 12A is inserted into speed-wire terminal 212A, and finally, feed-though hot wire 12A' is inserted into speed-wire terminal 212A'. A brass eyelet 13 is employed to interconnect the line side ground conductor 12C to the ground conductor 12C' in the feed-through cable. Once each ground conductor (12C, 12C') is inserted therein, the brass eyelet 13 is crimped to secure the ground wires. Those skilled in the art will understand that there are various ways of interconnecting the feed-through ground wire to the line side ground wire.

Figure 13:
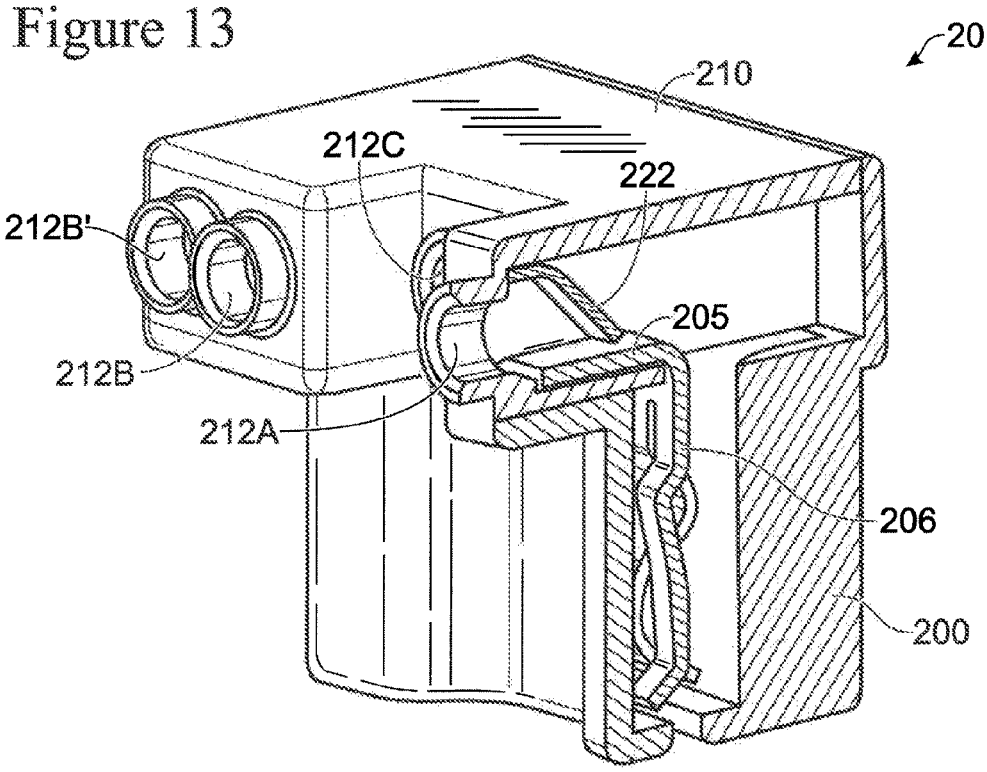
FIG. 13 is a cross-sectional view of a feed-through connector depicted in FIG. 12.

Referring to FIG. 13, a partial cross-sectional view of the plug connector 20 depicted in FIG. 12 is disclosed. In this view, the speed-wire terminal 212A is shown to include a flexure spring 222 that is biased toward the fixed plate portion 205 of female hot contact 206 which is accessible via the plug-in portion 200.

Figure 14:
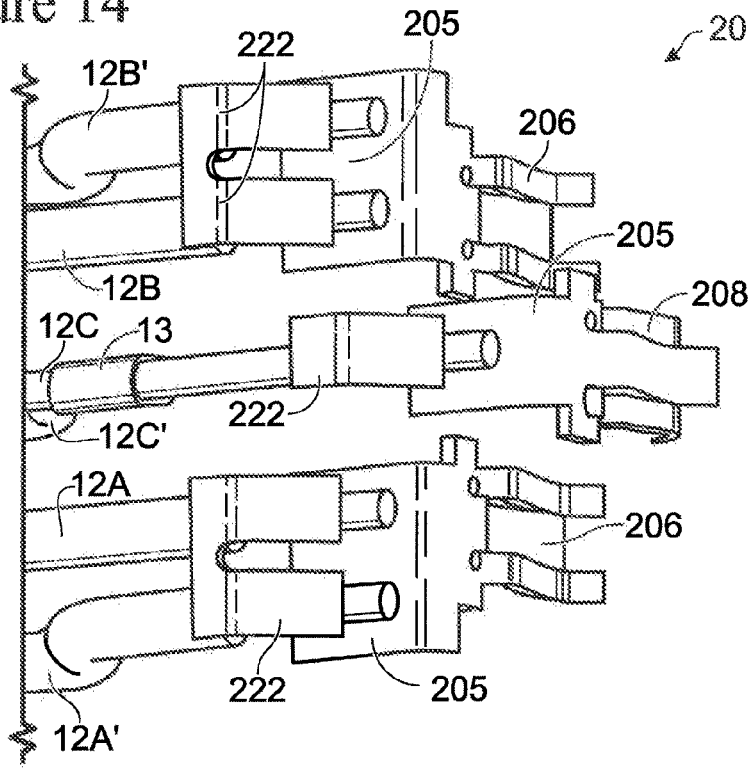
FIG. 14 is a detail view of a feed-through connector depicted in FIG. 12.

Referring to FIG. 14, a perspective detail view of plug connector 20 is shown, with the housing portions (200, 210) removed for ease of clarity. Using the hot side as an example, it is seen that U-shaped flexure contact 222 accommodates both the line hot wire 12A and the feed-through hot wire 12A'. Flexure spring 222, which is biased toward plate portion 205, is forced open by the insertion of the wires 12A, 12A'. However, the spring-action of flexure 222 provides an appropriate gripping force such that the inserted wires remain firmly in place within housing 210. In an alternate embodiment, plate member 205 may include a metallic saw-tooth mechanism that is configured to bite into the wire 12, securing it in place.

Those skilled in the art will understand that contacts 206 and 208 may be of any suitable type and reference is made to U.S. patent application Ser. No. 10/680,797, which is incorporated herein by reference as though fully set forth in its entirety, for a more detailed explanation of plug connectors 20 and plug contacts (206, 208).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. An electrical wiring system for use in an AC electrical circuit disposed between an AC distribution point and a terminus point, the AC electrical circuit including a hot AC power transmitting wire and a neutral AC power transmitting wire extending from the AC power distribution point to at least one wiring box, the AC distribution point being in an upstream direction relative to the at least one wiring box and the terminus point being in a downstream direction relative to the at least one wiring box, the at least one wiring box having at least one aperture and an open side, the AC hot power transmitting wire and the AC neutral power transmitting wire being routed into the at least one aperture and accessible at the open side after a rough-in phase of installation, the system comprising:

a connector including a housing having a connector hot contact assembly and a connector neutral contact assembly disposed therein, the housing including at least one first connector power interface and a second connector power interface, the at least one first connector power interface including a first hot contact portion of the connector hot contact assembly and a first neutral contact of the connector neutral contact assembly, the first hot contact portion being configured to terminate the hot AC power transmitting wire such that a first portion of the hot AC power transmitting wire extends in the upstream direction and a second portion of the hot AC power transmitting wire extends in the downstream direction, the first neutral contact portion being configured to terminate the neutral AC power transmitting wire such that a first portion of the neutral AC power transmitting wire extends in the upstream direction and a second portion of the neutral AC power transmitting wire extends in the downstream direction, the second connector power interface including a second hot contact portion of the connector hot contact assembly and a second neutral contact portion of the connector neutral contact assembly, the connector not being configured to connect to the wiring box; and an electrical wiring device including a device housing having a cover portion and rear portion, the cover portion including at least one user-accessible interface element connected to an AC electric circuit disposed in the device housing, the electrical wiring device also including mounting structure coupled to the device housing, the mounting structure being configured to couple the electrical wiring device to the device box, the electrical wiring device further including a wiring device power interface including a hot AC electric contact and a neutral AC electric contact, the wiring device power interface being configured to mate with the second connector power interface to establish electrical connectivity between the hot AC electric contact and the second hot contact portion, and the neutral AC electric contact and the second neutral contact portion.

2. The system of claim 1, wherein the second connector power interface includes a plug configured to mate with the wiring device power interface.

3. The system of claim 1, wherein the wiring device power interface includes a receptacle formed in the rear portion.

4. The system of claim 1, wherein at least one first connector power interface is disposed substantially normal to the second connector power interface.

5. The system of claim 1, wherein at least one first connector power interface includes a plurality of first power interfaces.

6. The system of claim 5, wherein the plurality of first power interfaces includes a hot AC power interface, a neutral AC power interface, and a ground interface.

7. The system of claim 6, wherein the hot power interface includes a flexure spring portion configured to connect the first portion of the hot AC power transmitting wire and the second portion of the hot AC power transmitting wire, and wherein the neutral power interface includes a flexure spring portion configured to connect the first portion of the neutral AC power transmitting wire and the second portion of the neutral AC power transmitting wire.

8. The system of claim 5, wherein the plurality of first power interfaces includes a plurality of speed-wire terminals.

9. The system of claim 1, wherein at least one first connector power interface includes a hot AC power insulation displacement interface, a neutral AC power insulation displacement interface, and a ground power insulation displacement interface.

10. The system of claim 1, wherein the first portion of the hot AC power transmitting wire and the second portion of the hot AC power transmitting wire are continuous after termination.

11. The system of claim 1, wherein the first portion of the hot AC power transmitting wire and the second portion of the hot AC power transmitting wire are discontinuous after termination.

12. The system of claim 1, wherein the first portion of the neutral AC power transmitting wire and the second portion of the neutral AC power transmitting wire are continuous after termination.

13. The system of claim 1, wherein the first portion of the neutral AC power transmitting wire and the second portion of the neutral AC power transmitting wire are discontinuous after termination.

14. The system of claim 1, wherein the second hot contact portion of the connector hot contact assembly and the second neutral contact portion include female contacts.

15. The system of claim 1, wherein the at least one first connector power interface is accessible via a first face portion of the connector, the first portion of the hot AC power transmitting wire and the second portion of the hot AC power transmitting wire being connected to the first hot contact portion by way of the first face portion, the first portion of the neutral AC power transmitting wire and the second portion of the neutral AC power transmitting wire also being connected to the first neutral contact portion by way of the first face portion.

16. The system of claim 1, wherein the second connector power interface includes a latching mechanism configured to lock the connector into the wiring device power interface, the latching mechanism being configured to resist a predetermined pulling force.

17. The system of claim 16, wherein the predetermined pulling force is approximately twenty-pounds applied for approximately one-minute.

18. The system of claim 17, wherein the latching mechanism is manually actuatable to permit removal of the connector from the wiring device power interface.

19. An electrical wiring system for use in an AC electric power distribution system, the AC electric power distribution system including a plurality of AC electric power transmitting wires including a plurality of hot power transmitting wires and a plurality of neutral power transmitting wires, the at least one wiring box having at least one aperture and an open side, the plurality of hot power transmitting wires and the plurality of neutral power transmitting wires being routed into a device box and accessible at an open side of the device box after a rough-in phase of installation, the system comprising:

a connector comprising a connector housing, a plurality of first contacts disposed in a predetermined pattern within the connector housing including a hot contact and a neutral contact, and a termination arrangement connected to the plurality of first contacts, the termination arrangement being configured to terminate the plurality of AC electric power transmitting wires by electrically connecting the plurality of hot power transmitting wires together and electrically connecting the plurality of neutral power transmitting wires together, the connector and the termination arrangement being arranged in a detached relationship relative to the device box after termination; and an electrical wiring device including a device housing including a face portion and rear portion, the face portion including a first set of receptacle blade openings disposed at one end of the device housing and a second set of receptacle blade openings disposed at an opposite end of the device housing, a mounting structure coupled to the device housing, the mounting structure being configured to couple the electrical wiring device to the device box, a hot contact structure disposed in the housing and including a first hot face receptacle contact structure in communication with a corresponding one of the first set of receptacle blade openings, a second hot face receptacle contact structure in communication with a corresponding one of the second set of receptacle blade openings, and a hot contact accessible via the connection arrangement, a neutral contact structure disposed in the housing and including a first neutral face receptacle contact structure in communication with a corresponding one of the first set of receptacle blade openings, a second neutral face receptacle contact structure in communication with a corresponding one of the second set of receptacle blade openings, and a neutral contact accessible via the connection arrangement, the connection arrangement being configured to latch the connector in a mating relationship such that the plurality of first contacts mate with the hot contact and the neutral contact to establish electrical continuity therebetween.

20. The system of claim 19, wherein the connection arrangement includes a receptacle formed in the rear portion, and the connector housing is configured to be insertable in the receptacle.

21. The system of claim 19, wherein the mating relationship is configured to withstand a predetermined pulling force of approximately twenty-pounds applied for approximately one-minute.

22. The system of claim 21, wherein the latching mechanism is manually actuatable to permit removal of the connector from the connection arrangement.

23. The system of claim 19, wherein a first hot AC power transmitting wire of the plurality of hot power transmitting wires extends in an upstream direction and a second hot AC power transmitting wire of the plurality of hot power transmitting wires extends in the downstream direction, and wherein a first neutral AC power transmitting wire of the plurality of neutral power transmitting wires extends in an upstream direction and a second neutral AC power transmitting wire of the plurality of neutral power transmitting wires extends in the downstream direction.

24. The system of claim 19, wherein the termination arrangement includes a hot AC power interface, a neutral AC power interface, and a ground interface.

25. The system of claim 24, wherein the hot power interface includes a flexure spring portion configured to connect a first hot AC power transmitting wire of the plurality of hot power transmitting wires and a second hot AC power transmitting wire of the plurality of hot power transmitting wires, and wherein the neutral power interface includes a flexure spring portion configured to connect a first neutral AC power transmitting wire of the plurality of neutral power transmitting wires and a second neutral AC power transmitting wire of the plurality of neutral power transmitting wires.

26. The system of claim 19, wherein the termination arrangement includes a plurality of speed-wire terminals.

27. The system of claim 19, wherein termination arrangement includes a hot AC power insulation displacement interface, a neutral AC power insulation displacement interface, and a ground power insulation displacement interface.

28. The system of claim 19, wherein the plurality of hot power transmitting wires are continuous after termination.

29. The system of claim 19, wherein the plurality of hot power transmitting wires are discontinuous after termination.

30. The system of claim 19, wherein the plurality of neutral power transmitting wires are continuous after termination.

31. The system of claim 19, wherein the plurality of neutral power transmitting wires are discontinuous after termination.

32. The system of claim 1, wherein the plurality of first contacts include female contacts.

33. An electrical wiring system for use in a wiring box attached to a structural member within a structure, the structure further including AC electrical wiring disposed between an AC power distribution point located upstream of the wiring box and a terminus point of the AC electrical wiring substantially disposed at the wiring box or at a location downstream thereof, the AC electrical wiring including a hot AC power transmitting wire and a neutral AC power transmitting wire, the system comprising:

a connector including a housing having a connector hot contact assembly and a connector neutral contact assembly disposed therein, the connector including a first connector power interface and a second connector power interface, the first connector power interface including a first hot contact portion of the connector hot contact assembly configured to terminate the hot AC power transmitting wire and a first neutral contact portion of the connector neutral contact assembly configured to terminate the neutral AC power transmitting wire, the second connector power interface including a second hot contact portion of the connector hot contact assembly and a second neutral contact portion of the connector neutral hot contact assembly, the wiring connector not being configured to connect to the wiring box; and an electrical wiring device including a device housing having a cover portion and rear portion, the cover portion including a first set of receptacle blade openings disposed at one end of the device housing and a second set of receptacle blade openings disposed at an opposite end of the device housing, the device housing including a hot contact structure comprising a first hot face receptacle contact structure in communication with a corresponding one of the first set of receptacle blade openings, a second hot face receptacle contact structure in communication with a corresponding one of the second set of receptacle blade openings, and a hot device interface contact, the device housing including a neutral contact structure comprising a first neutral face receptacle contact structure in communication with a corresponding one of the first set of receptacle blade openings, a second neutral face receptacle contact structure in communication with a corresponding one of the second set of receptacle blade openings, and a neutral device interface contact, the electrical wiring device also including mounting structure coupled to the device housing, the mounting structure being configured to couple the electrical wiring device to the device box, the electrical wiring device further including a wiring device power interface including the hot device interface contact and the neutral device interface contact, the wiring device power interface being configured to mate with the second connector power interface to establish electrical connectivity between the hot device interface contact and the second hot contact portion, and the neutral device interface contact and the neutral device interface contact.

34. The system of claim 33, wherein the first hot contact portion is configured to terminate the hot AC power transmitting wire such that a first portion of the hot AC power transmitting wire extends in the upstream direction and a second portion of the hot AC power transmitting wire extends in the downstream direction, the first neutral contact portion being configured to terminate the neutral AC power transmitting wire such that a first portion of the neutral AC power transmitting wire extends in the upstream direction and a second portion of the neutral AC power transmitting wire extends in the downstream direction.

35. The system of claim 33, wherein the second connector power interface includes a plug configured to mate with the wiring device power interface.

36. The system of claim 33, wherein the wiring device power interface includes a receptacle formed in the rear portion.

37. The system of claim 33, wherein the plurality of first power interfaces includes a plurality of speed-wire terminals.

38. The system of claim 36, wherein plurality of speed-wire terminals includes a hot speed-wire terminal interface and a neutral speed-wire terminal interface, the hot speed-wire terminal interface includes a flexure spring portion configured to connect the first portion of the hot AC power transmitting wire and the second portion of the hot AC power transmitting wire, and wherein the neutral speed-wire terminal interface includes a flexure spring portion configured to connect the first portion of the neutral AC power transmitting wire and the second portion of the neutral AC power transmitting wire.

39. The system of claim 33, wherein at least one first connector power interface includes a hot AC power insulation displacement interface, a neutral AC power insulation displacement interface, and a ground power insulation displacement interface.

40. The system of claim 33, wherein the first portion of the hot AC power transmitting wire and the second portion of the hot AC power transmitting wire are continuous after termination.

41. The system of claim 33, wherein the first portion of the hot AC power transmitting wire and the second portion of the hot AC power transmitting wire are discontinuous after termination.

42. The system of claim 33, wherein the first portion of the neutral AC power transmitting wire and the second portion of the neutral AC power transmitting wire are continuous after termination.

43. The system of claim 33, wherein the first portion of the neutral AC power transmitting wire and the second portion of the neutral AC power transmitting wire are discontinuous after termination.

44. The system of claim 33, wherein the second hot contact portion of the connector hot contact assembly and the second neutral contact portion include female contacts.

* * * * *